US006428397B1

(12) United States Patent
Stocker

(10) Patent No.: US 6,428,397 B1
(45) Date of Patent: Aug. 6, 2002

(54) WAFER EDGE POLISHING METHOD AND APPARATUS

(75) Inventor: Mark Andrew Stocker, East Hunsburg (GB)

(73) Assignee: Unova U.K. Limited, Aylesbury (GB)

( * ) Notice: Subject to any disclaimer, the term of this patent is extended or adjusted under 35 U.S.C. 154(b) by 0 days.

(21) Appl. No.: 09/720,111

(22) PCT Filed: Jun. 17, 1999

(86) PCT No.: PCT/GB99/01928

§ 371 (c)(1),
(2), (4) Date: Feb. 21, 2001

(87) PCT Pub. No.: WO99/67054

PCT Pub. Date: Dec. 29, 1999

(30) Foreign Application Priority Data

Jun. 25, 1998 (GB) ..... 9813606
May 12, 1999 (GB) ..... 9910898

(51) Int. Cl.[7] ..... B24B 9/06
(52) U.S. Cl. ..... 451/44; 451/254; 451/146
(58) Field of Search ..... 451/44, 254, 258, 451/140, 146

(56) References Cited

U.S. PATENT DOCUMENTS 4,344,260 A * 8/1982 Ogiwara ..... 451/44
5,317,836 A * 6/1994 Hasegawa et al. ..... 451/44
5,609,514 A * 3/1997 Yasunaga et al. ..... 451/44
5,944,584 A * 8/1999 Toyama ..... 451/41

FOREIGN PATENT DOCUMENTS

EP 0 549 143 A1 6/1993
EP 0 552 989 A1 7/1993
EP 0 601 748 A1 6/1994
EP 0 764 976 A1 3/1997
SU 1114528 * 9/1984 ..... 451/44

* cited by examiner

*Primary Examiner*—Robert A. Rose
(74) *Attorney, Agent, or Firm*—Lee, Mann, Smith, McWilliams Sweeney & Ohlson

(57) ABSTRACT

A semi-conductor wafer (12) has its inclined edge flanks polished by a grooved wheel (16) of synthetic plastics material, while a jet (20) of polishing slurry, which may comprise colloidal silica, is fed downwards into the zone of contact between the wheel and the wafer. The wheel (16) is preferably rocked or oscillated laterally such that a constant polishing force is alternatively applied to each flank of the wafer (12). The wheel may be mounted in a buffer store to which the wafers are transported from a grinding station which grinds the edge flanks.

10 Claims, 2 Drawing Sheets

WAFER EDGE POLISHING METHOD AND APPARATUS

FIELD OF INVENTION

This invention concerns the polishing of the edges of semi-conductor wafers such as silicon wafers and apparatus therefor.

BACKGROUND OF THE INVENTION

When silicon has been crystallised into large boules, which are generally cylindrical over most of their length, the crystalline material is sliced into thin circular discs known as silicon wafers, the diameter of each of which can be anything within the range 25–300 mm. After mounting in a vacuum chuck in an edge grinding machine, the peripheral edges of the discs are accurately ground so as to produce an accurate circular shape centered on the centre of the disc and a precisely formed edge profile, and are often notched at one position around the circular periphery.

Whereas over the majority of the area of disc the thickness is uniform and the two faces are parallel, the periphery of such discs are ground to a triangular section in which the apex of the triangle defines the outermost diameter of the wafer and is normally located midway between the two parallel faces of the disc.

In order to optimise the manufacture of semi-conductor devices using such a disc, it is important that the surface which is to be exposed to photo-lithography is damage free and in view of the microscopic size of the microcircuits which are formed on the wafers, damage near to the circumferential line between which the flat circular surface merges with the inclined surface leading to the apex, can significantly reduce the number of devices which can be made from the wafer.

In machines which do not produce a good quality ground finish to the inclined surfaces of the triangular section leading to the apex, it is necessary to etch and then polish the edges of the wafer before it can be used in the construction of semi-conductor devices. Where a good quality ground finish is produced on the inclined surfaces leading to the apex, it is only necessary to etch and polish a small quantity of material in order to obtain an undamaged edge.

It is an object of the present invention to provide an improved method and apparatus for polishing a finely ground wafer edge.

SUMMARY OF THE INVENTION

According to one aspect of the present invention there is provided a method of edge grinding and polishing circular workpieces which are transported in turn to a grinding station in which the edge of the workpiece is ground, and after grinding, the workpiece is transferred to a buffer store whilst the next workpiece is conveyed to and located in the grinding station for grinding, which further comprises the steps of rotating the workpiece in the buffer store and engaging the edge thereof with a polishing wheel, to polish its periphery whilst the next workpiece is being ground, and after polishing, the polished workpiece is removed and the said next wafer is transferred from the grinding station to the buffer store for polishing to allow a further workpiece to be located in the grinding station.

The workpieces awaiting grinding may be contained in a first store and the ground and polished workpieces may be contained in a second store. The first and second stores may be different sections of a single storage device.

The invention is particularly applicable to circular semi-conductor wafers.

The buffer store conveniently comprises a wash station and in accordance with a preferred aspect of the invention, a method of edge grinding and polishing wafers as aforesaid includes the step of washing the ground wafer before the polishing step.

The invention also lies in a method in which the wafer is washed after it has been polished.

The invention also lies in a method in which the wafer is washed both before and after the polishing step.

In accordance with a preferred feature of the invention, the method includes the step of forming and reforming a groove in the polishing wheel after one or more polishing steps have been performed.

The forming and reforming of the groove in the wheel may be effected by means of a groove-forming wheel having a triangular cross-section peripheral rim, defining in cross-section the two slanting frusto-conical edges which converge in an apex, and after polishing one or more wafers, relative movement is effected between the groove-forming wheel and the polishing wheel whilst both are rotating about their respective axes, thereby to form or reform the cross-sectional shape of the groove in the polishing wheel ready for polishing the edges of further wafers.

According to another aspect of the invention, apparatus for grinding the edges of circular wafers of semi-conductor material comprises a store within which disc-like wafers of semi-conductor material can be stored, a grinding station, means for conveying the wafers one at a time to the grinding station for effecting edge grinding thereof and after grinding conveying each wafer in turn to a buffer store and locating the wafer on a storage chuck therein, said conveying means selecting the next wafer from the store and conveying it to the grinding station to effect edge grinding thereof, a polishing wheel in the buffer store, means for rotating it and the wafer therein, means for effecting relative movement between the wafer and the polishing wheel to polish the edge of the wafer whilst the next wafer is being ground, and said conveying means serving to remove the polished wafer from the buffer store and selecting a further wafer from the store and conveying it to the grinding station for edge grinding thereof, before moving to the buffer store to recover the polished wafer from therein.

Preferably in methods and apparatus embodying the invention, a slurry is conveyed to the point of contact between the wafer and the polishing wheel so as to assist in the polishing action.

Typically the polishing wheel is compliant and is formed from a material such as urethane or serium oxide.

Typically the slurry comprises an alkali solution, preferably of pH11.

The method of the invention may preferably include the further step of effecting a rocking movement between the polishing wheel and the wafer edge by rocking either the wheel or the wafer about an axis, coincident with or parallel to a tangent which intersects the point of contact between the wafer and the polishing wheel.

In a preferred arrangement the wafer and the grooved polishing wheel are mounted for rotation about horizontally spaced apart parallel axes, the wafer is supported on a vacuum chuck and is rotated by a drive motor, the polishing wheel is driven in rotation by a second drive means, linear drive means is provided to advance and retract the polishing wheel relative to the wafer, and oscillatory drive means acts on the assembly of polishing wheel and associated drive so as to rock the wheel about a vertical axis so that the two side cheeks of the groove in the polishing wheel alternately engage the inclined edges of the edge region of the wafer.

In an alternative arrangement the wheel and its rotational drive remains stationary except for the rotation of the wheel about its axis, and linear translation means is provided for advancing the wafer and associated drive and support means towards and away from the grooved polishing wheel to engage the edge of the wafer in the groove, and oscillatory drive means serves to rock the wafer support and therefore the wafer thereon about a vertical axis so as to produce the alternating engagement between the external periphery of the wafer and the sides of the groove as the wafer and polishing wheel rotate.

References to oscillatory drive means include rocking drives and drives which rotate first in one direction and then the other about a single axis.

According to a further aspect of the invention, it is to be understood that the technique of rocking the wafer or the wheel whilst rotating so as to alternately engage the two inclined faces of the periphery of the wafer with the corresponding faces of the groove in the wheel, is not linked to an arrangement in which the wafer is mounted in a buffer store on, or associated with, an edge grinding machine. This further aspect of the invention can be incorporated into any wafer edge polishing machine in which either the wafer or the wheel can be adapted to be rocked alternately in one direction and then the other about an appropriate axis.

The invention therefore also lies in apparatus for wafer edge polishing in which there is provided means for rotating a wafer, a polishing wheel having a groove therein for accommodating the peripheral rim of the wafer, means for rotating the wheel, drive means for effecting relative movement between the wheel and the wafer to effect engagement of the wafer in the groove, and further drive means to effect relative rocking movement between the wafer and the wheel such that opposite faces of the peripheral rim of the wafer are engaged alternately by opposite regions of the surface of the groove in the wheel during the polishing process.

In any of the apparatus as aforesaid, a jet orifice is located near to the region of engagement between the wafer and the wheel, for directing a fluid slurry towards the region of engagement at least during the polishing process.

According to another feature of the invention, in any of the apparatus as aforesaid, a groove-forming wheel (a grooving tool) is mounted for engagement with the groove in the polishing wheel either by movement of the grooving tool towards the wheel or the wheel towards the tool, and for mutually rotating both wheel and tool so as to form or reform the groove in the surface of the wheel.

Where the grooving tool is a disc, the latter may be mounted to the rear of the wafer support for rotation therewith, and the forming step is performed by moving the grooved wheel into engagement with the grooving tool and rotating both so as to form or reform the groove in the wheel.

The invention also lies in any of the methods as aforesaid further comprising the step of projecting a fluid slurry towards the point of engagement between the grooved polishing wheel and the periphery of the wafer at least during polishing engagement therebetween.

The invention also lies in any of the methods as aforesaid in which a grooving tool (groove-forming wheel) is located in proximity to the grooved polishing wheel for engagement therewith to form and reform the groove in the wheel as required.

According to a further aspect of the invention, the polishing wheel has a significant axial depth, and two or more parallel grooves are formed therearound, so that as one groove becomes worn and needs reforming, the wheel can be indexed so as to use another of the grooves for polishing the edge of the wafer and the process of moving from one groove to another can be continued until all of the grooves have been utilised and need reforming before the process is arrested and a reforming process is performed on the polishing wheel grooves.

According to another aspect of the present invention, in a method of polishing the edge of a disc-like workpiece the latter is secured in position on a vacuum chuck for rotation about its centre, a polishing wheel of synthetic plastics material is brought into contact with the rotating edge of the workpiece having previously been formed around its polishing surface with a groove the cross-section of which is the complement of the edge profile of the disc, a polishing slurry is supplied to the zone of contact between the polishing wheel and the edge of the workpiece, and the polishing wheel is rotated so that relative movement exists between the polishing wheel and the disc edge.

Typically the polishing wheel is rotated contra to the direction of rotation of the workpiece in the zone of contact.

Typically the synthetics plastics material is polyurethane.

Typically the polishing slurry is colloidal silica.

Whereas with edge grinding, the grooved grinding wheel is advanced during the grinding process with a controlled feed rate, it has been found more preferable to advance a synthetic plastics polishing wheel in such a manner as to engage the edge of the workpiece in a so-called plunge mode and under constant force.

A polished surface has been obtained in a matter of a few minutes, typically of the order of 2 to 4 minutes.

The method may be performed as a modified edge grinding machine which thereby permits the disc to be edge ground and then polished while still mounted on the same chuck, by withdrawing the grinding wheel and advancing the polishing wheel and thereafter performing the aforesaid method. A washing step may be included between the grinding step an the polishing step.

Preferably the method is under the control of a computer programmed to instigate the different steps of the process.

According to another aspect of the present invention apparatus for performing the aforementioned method comprises a vacuum chuck for receiving and supporting a circular plate-like workpiece, drive means for rotating the chuck and therefore the workpiece about its centre, means for mounting a grooved polishing wheel and means for rotating same about its central axis so that its direction of rotation is contra that of the rotation of the workpiece in the region in which they will make contact, drive means for advancing and retracting the polishing wheel mounting means to enable the polishing wheel to make contact with the edge of the workpiece for polishing purposes, and means for adjusting the polishing wheel relative to the mounting means or the mounting means relative to the remainder of the apparatus, or both, to ensure that the groove in the surface of the polishing wheel accurately aligns with the edge of the workpiece, the apparatus further comprising means for supplying a polishing slurry to the zone of contact between the workpiece and the polishing wheel.

Preferably the apparatus further includes a forming wheel mounted for rotation about its central axis typically in a contra sense to the rotation of the polishing wheel where the two will come into contact, and means is provided for effecting relative movement between the polishing wheel and the forming wheel to engage the edge of the forming wheel with a surface of the polishing wheel to form a groove therein, the external periphery of the forming wheel corresponding to the external edge profile of the workpiece so that the groove in the polishing wheel corresponds to the edge profile of the workpiece.

In apparatus as aforesaid, the polishing wheel may have significant axial extent in the form of a cylinder, whereby as one grooved region thereof wears away as a result of the polishing activity, one or more further grooves can be formed at axially spaced positions therealong by appropriate indexing of either the forming wheel or the polishing wheel or both, and the apparatus is further programmed to introduce relative indexing between the forming wheel and polishing wheel and between the latter and the workpiece so that the appropriate groove in the surface of the polishing wheel is employed to polish the edge of the workpiece.

The means for supplying polishing slurry to the polishing zone preferably includes at least one nozzle for directing the slurry towards the edge of the workpiece.

Typically the nozzle or nozzles direct the slurry towards the small region of contact which exists between the polishing wheel and the workpiece.

Where the polishing wheel rotates significantly faster than the workpiece, it may assist if the slurry is directed towards the region of contact so as to be moving in the same direction as the periphery of the polishing wheel at the point of contact. Since the groove within the polishing wheel forms a small reservoir with the edge of the workpiece when the two are engaged, the rotation of the workpiece and polishing wheel may be selected so that the perimeter of the polishing wheel is moving in a downward sense at the point of contact so that the slurry can be projected down into the junction between the polishing wheel and the edge of the workpiece from above, so that a puddle of slurry is maintained in the small reservoir as aforesaid times during polishing.

Preferably the polishing action occurs within a generally closed environment so that slurry which is spattered away from the rotating parts is collected on the walls of the enclosure from which it can drain into a collection sump.

Preferably means is provided for draining slurry from the sump into a reservoir from which it can be drained or pumped for disposal or recovered for re-use.

Filtering means is preferably provided to remove particles from the slurry which are greater than a given size if the recovered slurry is to be reused.

Preferably means is provided for sensing the flow of slurry through the nozzle which includes an interlock for retracting the polishing wheel to disengage it from the workpiece in the event that the slurry flow ceases or drops below a predetermined flow rate.

In apparatus as aforesaid, where the polishing wheel is polyurethane, a preferred slurry is colloidal silica.

A preferred material for the polishing wheel is polyurethane.

The apparatus as aforesaid may comprise a wafer grinding machine in which one or more grinding wheels are advanced under computer control into engagement with the workpiece to effect an initial (or finish) grinding of the edge, and on which machine the polishing wheel is also mounted, and the polishing wheel again under computer control, is advanced into contact with the edge of the workpiece after the grinding process has been completed, to perform a polishing stage.

Where the polishing wheel is located on the grinding machine, the grinding wheel and polishing wheel may be mounted on the same wheelhead assembly for rotation by a common drive means such as an electric, hydraulic or pneumatic motor.

Where the same drive is used, the speed of rotation may be varied as between grinding and polishing as appropriate.

Furthermore, where the same advance and retract mechanism is used for advancing and retracting the grinding wheel and polishing wheel, the computer is further programmed to alter the feed characteristics from when the grinding wheel is advanced, to a constant force plunge mode for when the polishing wheel is to be used.

Since the grinding process will produce a considerable quantity of swarf and spatter during the grinding process, the grinding process is preferably carried out within a similar enclosure as is the preferred arrangement for the polishing step, and where the same enclosure is used, preferably a washing step is included between the grinding and polishing steps so as to wash the interior of the enclosure and more particularly at least the surface of the polishing wheel, to remove any traces of grinding swarf, before the polishing step is performed.

In addition or instead, a protective sleeve or housing may be provided for covering the polishing wheel except when the latter is to be made available for polishing, so that there is little or no chance of any grinding swarf finding its way onto the surface of the polishing wheel.

Where a sleeve or housing shrouds the polishing wheel during the grinding step, the shrouding enclosure is preferably openable and movable under control of the computer after the grinding process has ceased and any washing step has been performed to expose the polishing wheel and allow the latter to move into its polishing position.

The invention will now be described, by way of example, with reference to the accompanying drawings in which.

The invention is applicable to the polishing of semiconductor wafers which have been edge ground by an edge grinder such as described in UK Patent Specification No. 2317585.

Figure 1:
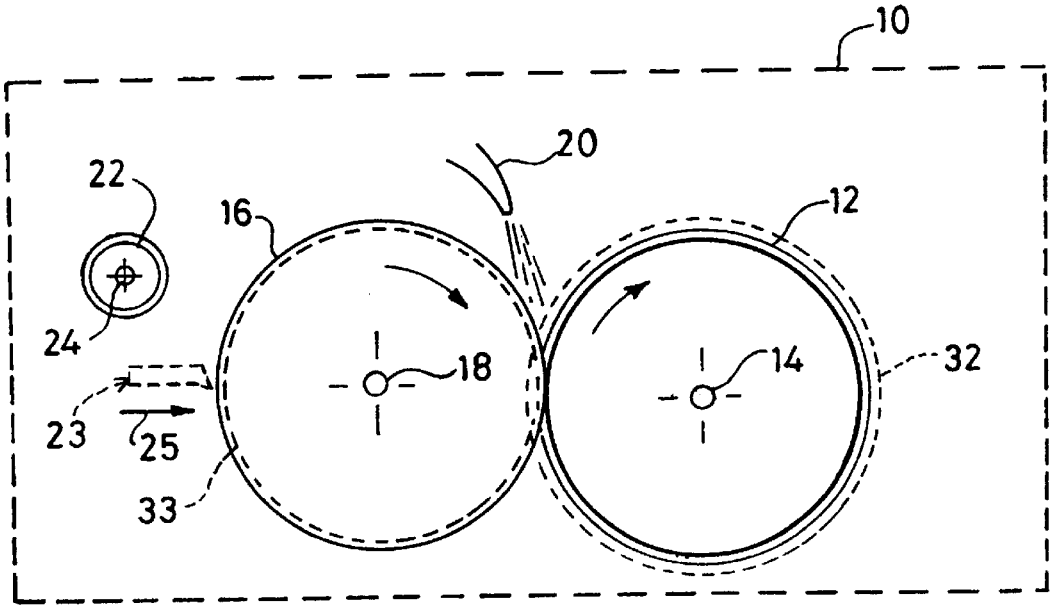
FIG. 1 is a diagrammatic elevation of a polishing wash station for use in combination with a wafer edge grinding apparatus.

The apparatus illustrated diagrammatically in FIG. 1 comprises a housing 10 within which is located a wafer 12 mounted on a vacuum chuck adapted for rotation about an axis 14, and a urethane polishing wheel 16 mounted for rotation about parallel axis 18.

A shallow V-shaped groove 33 is formed around the periphery of the polishing wheel 16. The wheel and the wafer are rotated as relative movement brings the two into engagement, so that the triangular section periphery of the wafer enters the groove 33 around the wheel. Both the wheel and the wafer are rotated clockwise, as shown by the arrows, so that there is contrary motion at the point of engagement.

A jet 20 projects a fluid polishing slurry downwards in the direction of motion of the peripheral region of the wheel 16 which will engage the wafer 12. The slurry may typically be an alkali solution of pH11 with colloidal silica having a mean particle size of 30–50 nm: for example a slurry known as Klubesol 50R50 manufactured by the company Clariant and diluted 10:1 with water.

Remote from the wafer is located a groove-forming wheel 22 rotatable about an axis 24. Relative movement between forming wheel 22 and polishing wheel 16 brings the edge of the wheel 22 into contact with the wheel 16 and into the groove 33 around the wheel. The peripheral shape of the forming wheel 22 is similar to the peripheral cross-sectional shape of the wafers such as 12 which are to be polished by the groove in the polishing wheel 16, and by forming the wheel 22 from a hard material and the polishing wheel 16 from a compliant material such as urethane, the groove 33 around the wheel will be formed or re-formed due to the engagement between the forming wheel and the groove in the polishing wheel.

As an alternative to the forming wheel 22, there may be provided a non-rotatable profiled turning tool 23, (shown in chain-dotted outline), which in operation is slidable in the direction of arrow 25 into engagement with the wheel 16 for forming or re-forming the groove 33.

Figure 2:
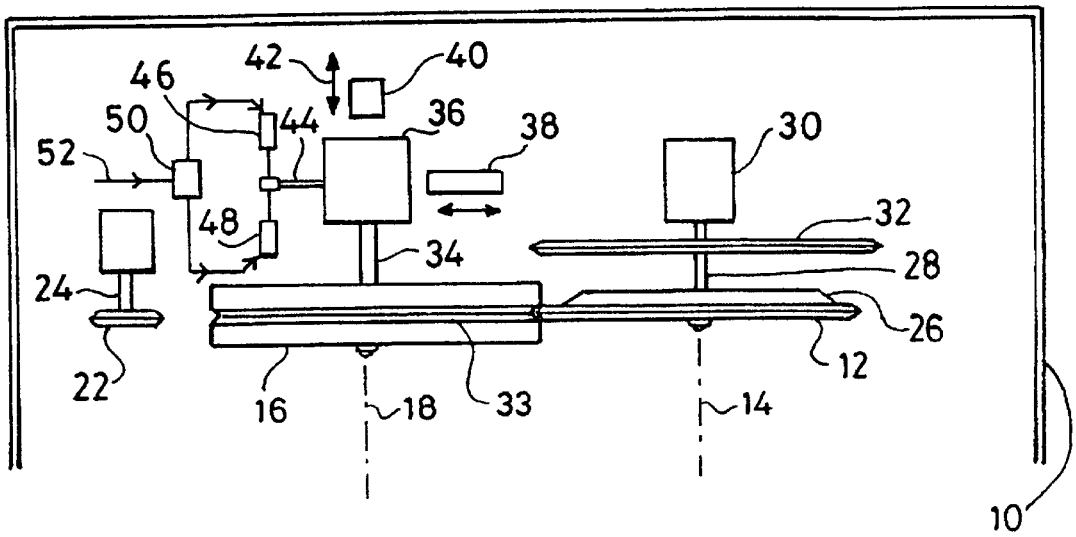
FIG. 2 is a diagrammatic top plan view of apparatus such as shown in FIG. 1.

FIG. 2 shows the apparatus of FIG. 1 in more detail and from above.

The wafer 12 is shown mounted on a vacuum chuck 26 carried by a spindle 28 driven in rotation by a motor 30. Optionally mounted on the shaft 28 (in place of wheel 22) is a groove-forming wheel 32 having a profiled periphery adapted to form the V-shaped groove 33 in the cylindrical face of the polishing wheel 16.

Polishing wheel 16 is carried by a shaft 34 driven in rotation by a motor 36.

The motor 36 is mounted on a slideway and is laterally slidable therealong under the action of an air cylinder 38 so as to effect engagement of the wafer 12 with the groove 33 or by appropriate axial movement by means of another drive 40, in the direction of the arrow 42, to effect engagement between the groove 33 and the groove-forming wheel 32.

The motor 36 is mounted for pivotal motion about a generally vertical axis relative to its slideways, and a lever 44 is shown extending from one side of the motor housing acted on by two piston and cylinder drive arrangements 46 and 48 which are selectively supplied with fluid such as air via a valve 50 from an air line 52.

By alternately supplying fluid to one and then the other of the drives 46, 48, so the pistons are driven in first one direction and then the other. This oscillates the lever 44, and therefore the motor attached thereto, so as to produce a rocking motion about the axis of pivoting.

Ideally the polishing wheel and drive assembly is carried by upper and lower pivoting arms which transfer the pivoting motion to an axis which extends substantially through the centre of the polishing wheel in a generally vertical sense. To this end the motor housing may be mounted between upper and lower arms which protrude therefrom in a forward sense above and below the polishing wheel 16 and vertically aligned pivot bearings are provided above and below the wheel to which the arms are attached and about which the arm assembly can swivel to effect the rocking motion of the wheel 16 relative to the wafer 12, about the vertical axis.

The rocking motion polishes the flanks of the triangular cross-sectional edge region of the wafer 12.

Figure 3:
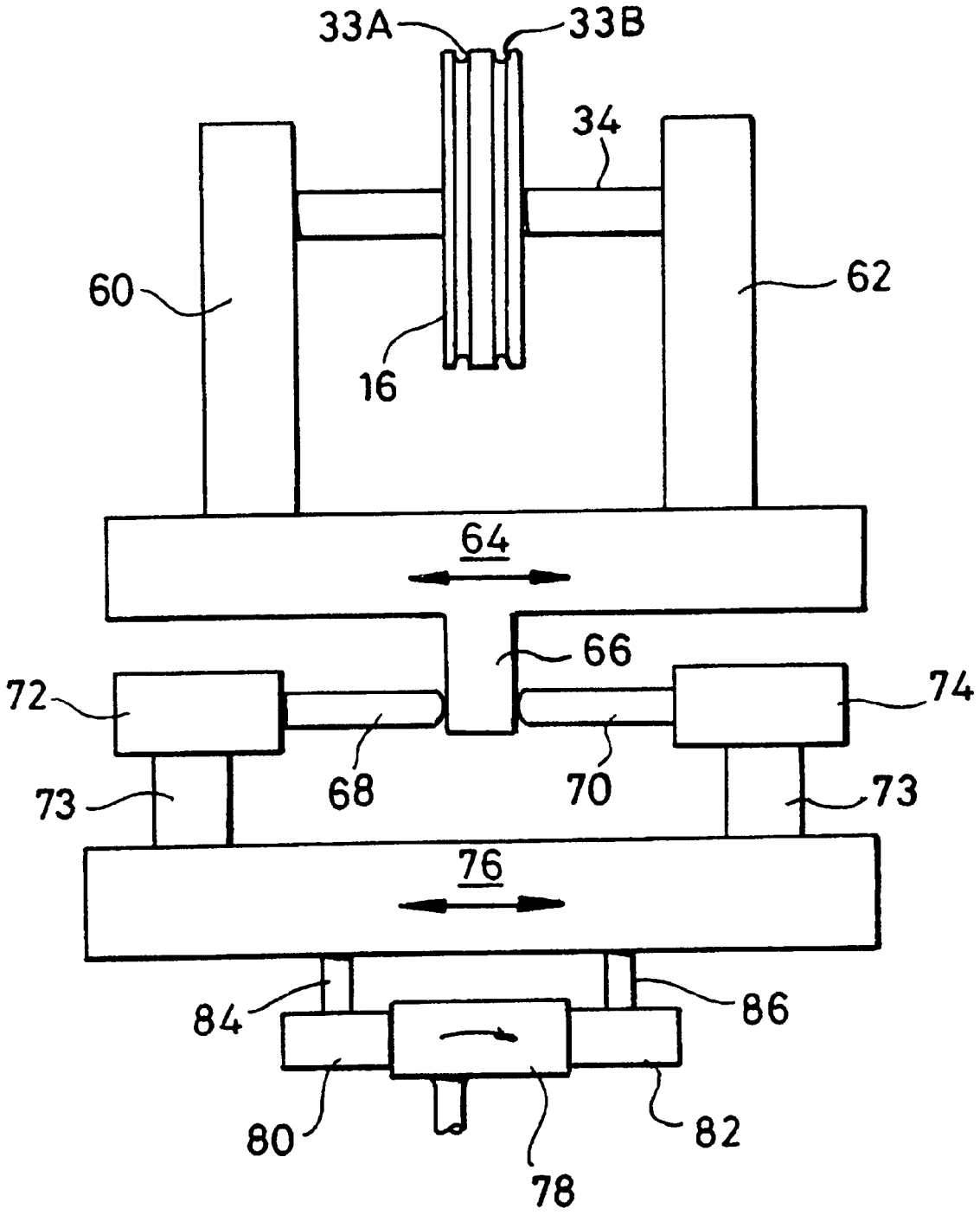
FIG. 3 is a diagrammatic view in elevation, showing a modified mechanism for causing the polishing wheel to execute an oscillating motion.

FIG. 3 shows in elevation a modified arrangement for causing the polishing wheel 16 to execute an oscillating motion relative to the wafer (not shown). The wheel is provided with two grooves 33 A and 33 B so that when one becomes worn the other can be utilised.

Here the wheel 16 is mounted on shaft 34 and supported by trunnions 60, 62 on a slideway 64 which is mounted horizontally parallel to the rotational axis of the wafer. The shaft 34 is again driven in rotation by a motor (not shown).

Projecting downwards from the slideway 64 is a spigot 66 whose opposite sides are engaged alternatively by push rods 68, 70 of respective air cylinders 72, 74, which in turn are mounted via supports 73 on a slidable plate 76. Horizontal movement of the plate, and hence of the cylinders, is controlled by a motor driven cam 78, such as an eccentric, engagable with rotatable cam followers 80, 82 whose spindles 84, 86 are connected to the plate 76.

If operation, rotation of the cam 78 causes spigot 66 to be engaged alternately by the two rods 68, 70. The air pressure P in the cylinders is regulated such that the lateral force exerted on the wafer flanks is constant, regardless of the actual displacement of the cylinder rods.

What is claimed is:

1. A method of edge grinding and polishing semiconductor wafers which are transported in turn to a grinding station in which the edge of the wafer is ground, and the wafer is then transferred to a buffer store whilst the next wafer is conveyed to and located in the grinding station for grinding, which further comprises the steps of rotating the wafer in the buffer store and engaging the edge thereof with a polishing wheel, to polish its periphery whilst the next wafer is being ground, and after polishing, the polished wafer is removed and the next wafer is transferred from the grinding station to the buffer store for polishing to allow a further wafer to be located in the grinding station, wherein the polishing step is effected by a rocking movement between the polishing wheel and the wafer edge by rocking either the wheel or the wafer about an axis, coincident with or parallel to a tangent which intersects the point of contact between the wafer and the polishing wheel.

2. A method according to claim 1 in which the wafers awaiting grinding are contained in a first store and the ground and polished wafers are contained in a second store.

3. A method according to claim 2 in which the first and second stores are different sections of a single storage device.

4. A method according to claim 1 in which the buffer store comprises a wash station and further comprising the step of washing the ground wafer before the polishing step.

5. A method according to claim 1 in which the wafer is washed after it has been polished.

6. A method according to claim 1, further including the step of forming and reforming a groove in the polishing wheel after one or more polishing steps have been performed.

7. A method according to claim 6 in which the forming and reforming of the groove in the polishing wheel is effected by means of a groove-forming wheel having a triangular cross-section peripheral rim, defining in cross-section two slanting frusto-conical edges which converge in an apex, and after polishing one or more wafers, relative movement is effected between the groove-forming wheel and the polishing wheel whilst both are rotating about their respective axes, thereby to form or reform the cross-sectional shape of the groove in the polishing wheel ready for polishing the edges of further wafers.

8. A method according to claim 1 further comprising the step of projecting a fluid slurry towards the point of engagement between the grooved polishing wheel and the periphery of the wafer at least during polishing engagement therebetween.

9. A method according to claim 1 in which a grooving tool (groove-forming wheel) is located in proximity to the grooved polishing wheel for engagement therewith to form and reforn the groove in the wheel as required.

10. A method according to claim 1 in which the polishing wheel is made of synthetic plastics material and is brought into contact with the rotating edge of the wafer, said wheel having previously been formed around its polishing surface with a groove the cross-section of which is the complement of the edge profile of the wafer, a polishing slurry is supplied to the zone of contact between the polishing wheel and the edge of the wafer, and the polishing wheel is rotated so that relative movement exists between the polishing wheel and the said edge.

* * * * *